US005494883A

United States Patent [19]

Simpson et al.

[11] Patent Number: 5,494,883

[45] Date of Patent: Feb. 27, 1996

[54] EXTRUDED RECEIVER OF A TRANSITION METAL ION SALT OF A COPOLYMER

[75] Inventors: William H. Simpson, Pittsford; Bruce C. Campbell; William A. Mruk, both of Rochester. all of N.Y.

[73] Assignee: Eastman Kodak Company, Rochester, N.Y.

[21] Appl. No.: 360,910

[22] Filed: Dec. 21, 1994

[51] Int. Cl.[6] ..... B41M 5/035; B41M 5/38

[52] U.S. Cl. ..... 503/227; 428/195; 428/500; 428/513; 428/516; 428/913; 428/914

[58] Field of Search ..... 8/471; 428/195, 428/500, 513, 516, 913, 914; 503/227

[56] References Cited

U.S. PATENT DOCUMENTS

| | | | |
|---|---|---|---|
| 3,264,272 | 8/1966 | Rees | 260/78.5 |
| 4,987,049 | 1/1991 | Komamura et al. | 430/203 |
| 5,240,897 | 8/1993 | Braun et al. | 503/209 |
| 5,280,005 | 1/1994 | Nakajima et al. | 503/227 |

*Primary Examiner*—B. Hamilton Hess
*Attorney, Agent, or Firm*—Harold E. Cole

[57] ABSTRACT

A thermally-transferred metallizable dye comprising a support having thereon a dye image-receiving layer, wherein the dye image-receiving layer comprises an extruded polymer comprising a transition metal ion salt of a carboxylic acid.

12 Claims, No Drawings

EXTRUDED RECEIVER OF A TRANSITION METAL ION SALT OF A COPOLYMER

This invention relates to an extruded receiver of a transition metal ion salt of a copolymer and a thermal dye transfer process for its use, and more particularly to an extruded polymer comprising a transition metal ion salt of a carboxylic acid.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta or yellow signals, and the process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

U.S. Pat. No. 5,240,897, 4,987,049 and 5,280,005 relate to a dye diffusion printing process in which a metallizable dye precursor is thermally transferred from a dye-donor element to a dye-receiver element containing a metal ion. The dye-receiving element is prepared by coating a metal atom-containing polymer, dissolved in a solvent, onto a support. After transfer, the metallized dye precursor forms a dye complex with the metal ion in the receiver.

However, there is a problem with that process in that the reaction between the metallizable dye precursor and the metal ion is frequently incomplete, so that the resulting print densities are relatively low. Further, solvents are expensive and are environmentally unfriendly because of emissions and liquid waste.

It is an object of this invention to provide a dye-receiving element for use with a dye-donor element containing a metallizable dye which provides an increased transfer density over that obtained by the prior art, without sticking of the dye-donor to the dye-receiver. It is another object of this invention to provide a thermal dye transfer process and assemblage for using such a receiver.

These and other objects are achieved in accordance with this invention which relates to a dye-receiving element for receiving a thermally-transferred metallizable dye comprising a support having thereon a dye image-receiving layer, wherein the dye image-receiving layer comprises an extruded polymer comprising a transition metal ion salt of a carboxylic acid.

Another embodiment of the invention relates to a process of forming a dye transfer image comprising imagewise-heating, by means of a thermal print head, a dye-donor element comprising a support having thereon a dye layer comprising a sublimable, metallizable dye precursor dispersed in a polymeric binder, and transferring a dye image to the dye-receiving element described above.

In a preferred embodiment of the invention, the transition metal ion is cobalt (II), nickel (II), copper (II), zinc (II) or iron (II).

In another preferred embodiment of the invention, the extruded polymer comprises a copolymer of ethylene and acrylic acid. In still another preferred embodiment, the extruded polymer is a copolymer of ethylene and a zinc salt of methacrylic acid. Such polymers are available commercially as Surlyn® 1652 and Surlyn® 1855 from DuPont Co.

The extruded polymer of the dye image-receiving layer may be present in any amount which is effective for its intended purpose. In general, good results have been obtained at a receiver layer concentration of from about 0.5 to about 30 g/m$^2$.

Any sublimable, metallizable dye precursor can be employed in the dye-donor element used in the invention provided it will react with the transition metal ion salt in the dye-receiving layer to form a metallized dye. For example, there may be employed chelate dyes such as

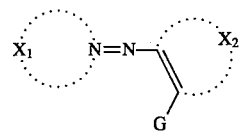

wherein $X_1$ represents a group of atoms necessary to complete an aromatic carbon ring or heterocyclic ring in which at least one ring comprises 5 to 7 atoms, and at least one position adjacent to the carbon bonded to the azo group is carbon, nitrogen, oxygen or sulfur;

$X_2$ represents a group of atoms necessary to complete an aromatic carbon ring or heterocyclic ring in which at least one ring comprises 5 to 7 atoms; and G represents a chelating group such as —QH, —NH-$COCH_3$, —COOH, etc.

Other chelate dyes useful in the invention have the following formula:

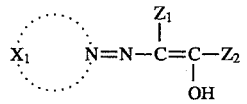

wherein $X_1$ is the same as above;

$Z_1$ represents an electron-accepting group; and $Z_2$ represents an alkyl group or an aryl group.

Specific examples of dyes represented by the above formulas are disclosed in JP 78893/84, JP 109394/84 and JP 2398/85 and U.S. Pat. No. 5,280,005. Other chelate dyes useful in the invention are disclosed in U.S. Pat. No. 5,240,897.

A dye-receiving element prepared in accordance with this invention does not involve solvents, and thus is environmentally advantageous. Further, the resulting material exhibits no donor/receiver sticking during the thermal printing step. The extruded and laminated receiver layer also has excellent adhesion to the support.

The support for the dye-receiving element employed in the invention may be transparent or reflective, and may comprise a polymeric, synthetic paper, or cellulosic paper support, or laminates thereof. Examples of transparent supports include films of poly(ether sulfone)s, polyimides, poly(ethylene naphthalate), cellulose esters such as cellulose acetate, poly(vinyl alcohol-co-acetal)s, and poly(ethylene terephthalate). The support may be employed at any desired thickness, usually from about 10 μm to 1000 μm. Additional polymeric layers may be present between the support and the dye image-receiving layer. For example, there may be employed a polyolefin such as polyethylene or polypropylene. White pigments such as titanium dioxide, zinc oxide, etc., may be added to the polymeric layer to provide reflectivity. In addition, a subbing layer may be used over this polymeric layer in order to improve adhesion to the dye image-receiving layer. Such subbing layers are disclosed in U.S. Pat. Nos. 4,748,150, 4,965,238, 4,965,239, and 4,965,241, the disclosures of which are incorporated by reference. The receiver element may also include a backing layer such as those disclosed in U.S. Pat. Nos. 5,011,814 and 5,096,875, the disclosures of which are incorporated by reference.

Resistance to sticking during thermal printing may be enhanced by the addition of release agents to the dye-receiving layer or to an overcoat layer, such as silicone-based compounds, as is conventional in the art.

Thermal printing heads which can be used to transfer dye from dye-donor elements to the receiving elements of the invention are available commercially. There can be employed, for example, a Fujitsu Thermal Head (FTP-040 MCS001), a TDK Thermal Head F415 HH7-1089 or a Rohm Thermal Head KE 2008-F3.

A thermal dye transfer assemblage of the invention comprises (a) a dye-donor element, and (b) a dye-receiving element as described above, the dye-receiving element being in a superposed relationship with the dye-donor element so that the dye layer of the donor element is in contact with the dye image-receiving layer of the receiving element.

In a preferred embodiment of the invention, a dye-donor element is employed which comprises a poly(ethylene terephthalate) support coated with sequential repeating areas of cyan, magenta and yellow dye, and the dye transfer steps described above are sequentially performed for each color to obtain a three-color dye transfer image. Of course, when the process is only performed for a single color, then a monochrome dye transfer image is obtained.

The following example is provided to further illustrate the invention.

Example

Donor

A dye-donor element was prepared by coating on a 6 μm poly(ethylene terephthalate support) a dye layer comprising the metallizable magenta dye precursor identified below (0.269 g/m$^2$), CAP 482-0.5 (0.5 s cellulose acetate propionate) (Eastman Chemical Co.) (0.101 g/m$^2$), CAP 482-20 (20 s cellulose acetate propionate) (Eastman Chemical Co.)(0.303 g/m$^2$), FC-431® perfluoroamido surfactant (3M Co.) (0.054 g/m$^2$), S361-N11® surfactant (Shamrock Technologies Co.) (0.022 g/m$^2$) (a micronized blend of polyethylene, polypropylene, and oxidized polyethylene particles), toluene (58.4 wt. %), methanol (25 wt. %) and cyclopentane (4.4 wt. %).

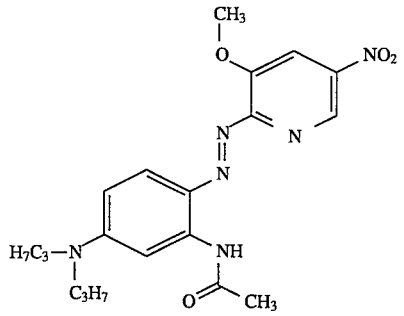

A slipping layer was coated on the reverse side of the support (the side opposite from the dye side) to reduce friction between donor and printed head, as described in Example 1 of U.S. Pat. No. 5,350,732.

Receiver

Thermal dye-transfer receiving elements were prepared by extrusion-coating the ionomers described below onto the top surface of a microvoided support (packaging film side). This support consisted of a cellulose paper core with a back coating of polyethylene (30.2 g/m$^2$) and the front side is a microvoided packaging film (Mobil OPP 350TW® available from Mobil Corp.) which had been extrusion-laminated with 12.2 g/m$^2$ polyethylene to the front side of the paper core. Details of this microvoided support structure is described in detail in U.S. Pat. No. 5,244,861, the disclosure of which is hereby incorporated by reference.

An ionomer is an ionically crosslinked thermoplastic polymer. For these test samples, Surlyn® ionomers (DuPont) were used. Surlyn® is an ethylene/methacrylic acid copolymer with sodium(Na) or zinc(Zn) as the crosslinking ion.

Control: Surlyn® 1605 (sodium ion) was extrusion-coated coated onto the above described receiver support at a coverage of 12 g/m$^2$.

E-1: Surlyn® 1652 (zinc ion) was extrusion-coated onto the above described receiver support at a coverage of 12 g/m$^2$.

E-2: Surlyn® F1855 (zinc ion) was extrusion-coated onto the above described receiver support at a coverage of 12 g/m$^2$.

E-3: Surlyn® F1855 (zinc ion) was extrusion-coated onto the above receiver support at a coverage of 24 g/m$^2$.

An additional thermal dye transfer receiving element (E-4) was prepared by extrusion-coating Surlyn® F1855 at a coverage of 24 g/m$^2$ directly onto a paper stock support. The paper stock support was 137 μm thick and made from a 1:1 blend of Pontiac Maple 51 (a bleached maple hardwood kraft of 0.5 μm length weighted average fiber length, available from Consolidated Pontiac, Inc.) and Alpha Hardwood Sulfite (a bleached red-alder hardwood sulfite of 0.69 μm average fiber length, available from Weyerhaeuser Paper Co.). The backside of the paper stock support was coated with high-density polyethylene (24 g/m$^2$).

Printing

The imaged prints were prepared by placing the dye-donor element in contact with the polymeric dye-receiving layer side of the receiver element. The assemblage was fastened to the top of the motor driven 53 mm diameter rubber roller. A TDK thermal head, L-231, thermostated at 30° C. was pressed with a force of 36N against the dye-donor element side of the assemblage pushing it against the rubber roller. The TDK L-231 thermal print head has 512 independently addressable heaters with a resolution of 5.4 dots/mm, an active printing width of 95 mm and an average heater resistance of 512 ohms. The imaging electronics were activated and the assemblage was drawn between the print head and roller at 20.6 mm/s. Coincidentally, the resistive elements in the thermal print head were pulsed on for 128 μs every 130 μs. Printing maximum density requires 127 pulses "on" time per printed line of 17 millisec. The images were printed with a 1:1 aspect ratio and a range of maximum energy from 14 to 19 J/cm$^2$.

The printed images consisted of small squares, each printed at a uniform, but different, print energy. A reflection dye density for each square was measured by using an X-Rite Densitometer (X-Rite Corp., Grandville, Mich.) with Status A filters. The following results were obtained:

TABLE I

| | Status A Red Reflection Density | | | | |
|---|---|---|---|---|---|
| RECEIVER: | CONTROL | E-1 | E-2 | E-3 | E-4 |
| STEP # | | | | | |
| 1 | 0.43 | 1.38 | 1.31 | 1.54 | 1.60 |
| 2 | 0.36 | 1.28 | 1.04 | 1.44 | 1.50 |
| 3 | 0.31 | 1.14 | 0.70 | 1.33 | 1.34 |
| 4 | 0.25 | 1.00 | 0.43 | 1.15 | 1.06 |
| 5 | 0.22 | 0.83 | 0.29 | 0.95 | 0.66 |
| 6 | 0.19 | 0.65 | 0.21 | 0.73 | 0.40 |
| 7 | 0.16 | 0.52 | 0.16 | 0.55 | 0.21 |
| 8 | 0.15 | 0.38 | 0.15 | 0.47 | 0.12 |
| 9 | 0.13 | 0.22 | 0.10 | 0.42 | 0.10 |
| 10 | — | — | — | 0.35 | — |
| Dmin | 0.10 | 0.10 | 0.10 | 0.10 | 0.10 |

The above results show that a substantial increase in the Status A red density is observed wherever the metallizable Dye 1 is printed onto the zinc-containing receiver, in comparison to the control receiver containing a sodium ion. E-3 represents an increase in the coverage of zinc-containing receiver which results in an increased red density over that observed in E-2.

The invention has been described in detail with particular reference to preferred embodiments thereof, but it will be understood that variations and modifications can be effected within the spirit and scope of the invention.

What is claimed is:

1. A process of forming a dye transfer image comprising imagewise-heating, by means of a thermal print head, a dye-donor element comprising a support having thereon a dye layer comprising a sublimable, metallizable dye precursor dispersed in a polymeric binder, and transferring a dye image to a dye-receiving element comprising a support having thereon a dye image-receiving layer containing a metal ion to form said dye transfer image, wherein said dye image-receiving layer comprises an extruded polymer comprising a transition metal ion salt of a carboxylic acid.

2. The process of claim 1 wherein said extruded polymer comprises a copolymer of ethylene and acrylic acid.

3. The process of claim 1 wherein said extruded polymer is a copolymer of ethylene and a zinc salt of methacrylic acid.

4. The process of claim 1 wherein said transition metal ion is cobalt (II), nickel (II), copper (II), zinc (II) or iron (II).

5. The process of claim 4 wherein said transition metal ion is zinc (II).

6. The process of claim 1 wherein said sublimable, metallizable dye precursor has the formula:

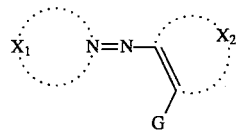

wherein $X_1$ represents a group of atoms necessary to complete an aromatic carbon ring or heterocyclic ring in which at least one ring comprises 5 to 7 atoms, and at least one position adjacent to the carbon bonded to the azo group is carbon, nitrogen, oxygen or sulfur;

$X_2$ represents a group of atoms necessary to complete an aromatic carbon ring or heterocyclic ring in which at least one ring comprises 5 to 7 atoms; and G represents a chelating group.

7. A thermal dye transfer assemblage comprising:

(a) a dye-donor element comprising a support having thereon a dye layer comprising a sublimable, metallizable dye precursor dispersed in a polymeric binder, and (b) a dye-receiving element comprising a support having thereon a dye image-receiving layer containing a metal ion, said dye-receiving element being in a superposed relationship with said dye-donor element so that said dye layer is in contact with said dye image-receiving layer; wherein said dye image-receiving layer comprises an extruded polymer comprising a transition metal ion salt of a carboxylic acid.

8. The assemblage of claim 7 wherein said extruded polymer comprises a copolymer of ethylene and acrylic acid.

9. The assemblage of claim 7 wherein said extruded polymer is a copolymer of ethylene and a zinc salt of methacrylic acid.

10. The assemblage of claim 7 wherein said transition metal ion is cobalt (II), nickel (II), copper (II) , zinc (II) or iron (II).

11. The assemblage of claim 10 wherein said transition metal ion is zinc (II).

12. The assemblage of claim 7 wherein said sublimable, metallizable dye precursor has the formula:

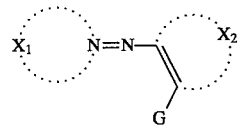

wherein $X_1$ represents a group of atoms necessary to complete an aromatic carbon ring or heterocyclic ring in which at least one ring comprises 5 to 7 atoms, and at least one position adjacent to the carbon bonded to the azo group is carbon, nitrogen, oxygen or sulfur;

$x_2$ represents a group of atoms necessary to complete an aromatic carbon ring or heterocyclic ring in which at least one ring comprises 5 to 7 atoms; and G represents a chelating group.

* * * * *